US010217350B2

(12) United States Patent
Dey et al.

(10) Patent No.: US 10,217,350 B2
(45) Date of Patent: Feb. 26, 2019

(54) ADAPTIVE EXCEPTION HANDLING IN SECURITY SYSTEM

(71) Applicant: Google Inc., Mountain View, CA (US)

(72) Inventors: Sourav Raj Dey, South San Francisco, CA (US); Mark Rajan Malhotra, San Mateo, CA (US); Jeffery Theodore Lee, Los Gatos, CA (US); Yash Modi, San Mateo, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/671,019

(22) Filed: Aug. 7, 2017

(65) Prior Publication Data

US 2017/0337807 A1 Nov. 23, 2017

Related U.S. Application Data

(63) Continuation of application No. 14/984,410, filed on Dec. 30, 2015, now Pat. No. 9,728,076.

(51) Int. Cl.
*G08B 25/00* (2006.01)
*G08B 29/18* (2006.01)

(52) U.S. Cl.
CPC ..... *G08B 29/185* (2013.01); *G08B 25/008* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,951,029 | A | 8/1990 | Severson | |
| 5,783,989 | A | 7/1998 | Issa et al. | |
| 6,577,234 | B1 | 6/2003 | Dohrmann et al. | |
| 7,482,924 | B1 * | 1/2009 | Beinhocker | G08B 13/186 250/227.14 |
| 9,142,108 | B2 | 9/2015 | Seelman | |
| 2006/0161993 | A1 * | 7/2006 | Cvek | A47B 21/0073 726/34 |
| 2008/0180240 | A1 * | 7/2008 | Raji | G08B 13/08 340/526 |

(Continued)

OTHER PUBLICATIONS http://www.califomiasecuritypro.com/blog/bid/164739/Four-Ways-to-Arm-Your-ADT-Home-Security-System.

(Continued)

*Primary Examiner* — Nabil H Syed
*Assistant Examiner* — Cal J Eustaquio
(74) *Attorney, Agent, or Firm* — Morris & Kamlay LLP

(57) ABSTRACT

A method of controlling a security system of a premises includes detecting one or more exceptions when the system is set to an alarm mode, determining whether any of the one or more exceptions is a terminal exception, automatically executing an arming procedure according to the alarm mode when all of the exceptions are determined to be non-terminal exceptions, preventing execution of the arming procedure when any of the exceptions are determined to be a terminal exception, and, while in the alarm mode, preventing a sensor associated with a security exception from triggering an alarm when the security exception is fully corrected, and triggering an alarm when a condition that is causing the security exception is adjusted without resulting in full correction of the security exception.

13 Claims, 6 Drawing Sheets

100

(56) References Cited

U.S. PATENT DOCUMENTS

| | | | | |
|---|---|---|---|---|
| 2013/0057405 | A1* | 3/2013 | Seelman | G08B 29/185 340/545.2 |
| 2014/0359101 | A1* | 12/2014 | Dawes | H04L 41/18 709/223 |
| 2016/0189496 | A1* | 6/2016 | Modi | G08B 13/08 340/545.2 |

OTHER PUBLICATIONS http://www.protection1.com/support/technical/how-to/ademco/bypass-zone/.
https://www.protex.me/dmp-7360-keypad-users-guide/#bypass-faulted-zone.
"ADT PremisePro Security System User Manual", 24 pgs.
"Model XR200 Command Processor Panel & Model XR2400F Fire Alarm Control Panel Programming Guide", 56 pgs.
"Vista-128FBP, Vista-250FBP Commercial Fire and Burglary Partitioned Security Systems with Scheduling User Guide", 80 pgs.

* cited by examiner

| | Definition | Override | History | Priority |
|---|---|---|---|---|
| 710 | DEN_TS_LIGHT=(1,15) | Automatic | 0 | 3 |
| 720 | BDR_TS_SOUND=(1,10) | Automatic | 0 | 3 |
| 730 | FD_ED_OPEN=(0,0) | Automatic | 0 | 2 |
| | SD_ED_OPEN=(0,0) | Manual | 1 | 2 |
| | CONTROLLER_STATUS=1 | Terminal | 0 | 1 |
| | | ... | | |

700

FIG. 7

ADAPTIVE EXCEPTION HANDLING IN SECURITY SYSTEM

BACKGROUND

Homes, offices, and other buildings may be equipped with smart networks to provide automated control of devices, appliances and systems, such as heating, ventilation, and air conditioning ("HVAC") system, lighting systems, home theater, entertainment systems, as well as security systems. A security system may include one or more sensors installed throughout a premises. The sensors may, for example, detect movement or changes in light, sound, or temperature.

Security system operational modes may include different types of alarm modes, such as an "AWAY" mode and a "STAY" mode. In an AWAY mode the security system may operate under the assumption that no authorized parties are in the premises; therefore all sensors, interior and perimeter, may be armed to trigger an alarm. In a STAY mode the security system may operate under the assumption that authorized parties are present within the premises but will not be entering/leaving without notifying the system; therefore data from interior sensors will not be armed to trigger an alarm while perimeter sensors are armed to trigger an alarm. However, in either an AWAY mode or a STAY mode, exceptions may occur that prevent a full arming of the sensors as required by the respective alarm mode or cause a malfunction in the system itself.

BRIEF SUMMARY

According to an embodiment of the disclosed subject matter a method of controlling a security system of a premises includes detecting one or more exceptions when the system is set to an alarm mode, determining whether any of the one or more exceptions is a terminal exception, automatically executing an arming procedure according to the alarm mode when all of the exceptions are determined to be non-terminal exceptions, preventing execution of the arming procedure when any of the exceptions are determined to be a terminal exception, and, while in the alarm mode, preventing a sensor associated with a security exception from triggering an alarm when the security exception is fully corrected, and triggering an alarm when a condition that is causing the security exception is adjusted without resulting in full correction of the security exception.

According to an embodiment of the disclosed subject matter, a security system includes a plurality of sensors installed at a premises to capture data from an environment in or around the premises, a memory configured to store data captured spanning at least a first period of time, and a processor configured to automatically receive data from devices installed in the premises when the security system is set to an alarm mode, detect, based on the received data, one or more exceptions, determine whether any of the one or more exceptions is a terminal exception, automatically execute an arming procedure according to the alarm mode when all of the exceptions are determined to be non-terminal exceptions, prevent execution of the arming procedure when any of the exceptions are determined to be a terminal exception, and, while in the alarm mode, prevent a sensor associated with a security exception from triggering an alarm when the security exception is fully corrected, and trigger an alarm when a condition that is causing the security exception is adjusted without resulting in full correction of the security exception.

According to an embodiment of the disclosed subject matter, a method of controlling a security system of a premises includes storing data captured from sensors over a period of time, determining an exception rule based on a trend identified in the data, storing the exception rule in an database, detecting an exception based on an exception rule stored in the database when the security system is set to an alarm mode, transmitting, to a user, a notification identifying the exception, and automatically executing an arming procedure according to the alarm mode.

According to an embodiment of the disclosed subject matter, means for controlling a security system of a premises are provided including means for detecting one or more exceptions when the system is set to an alarm mode, determining whether any of the one or more exceptions is a terminal exception, automatically executing an arming procedure according to the alarm mode when all of the exceptions are determined to be non-terminal exceptions, preventing execution of the arming procedure when any of the exceptions are determined to be a terminal exception, and, while in the alarm mode, preventing a sensor associated with a security exception from triggering an alarm when the security exception is fully corrected, and triggering an alarm when a condition that is causing the security exception is adjusted without resulting in full correction of the security exception.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

FIG. 7 shows an example exception database according to an embodiment of the disclosed subject matter.

DETAILED DESCRIPTION

Figure 1:
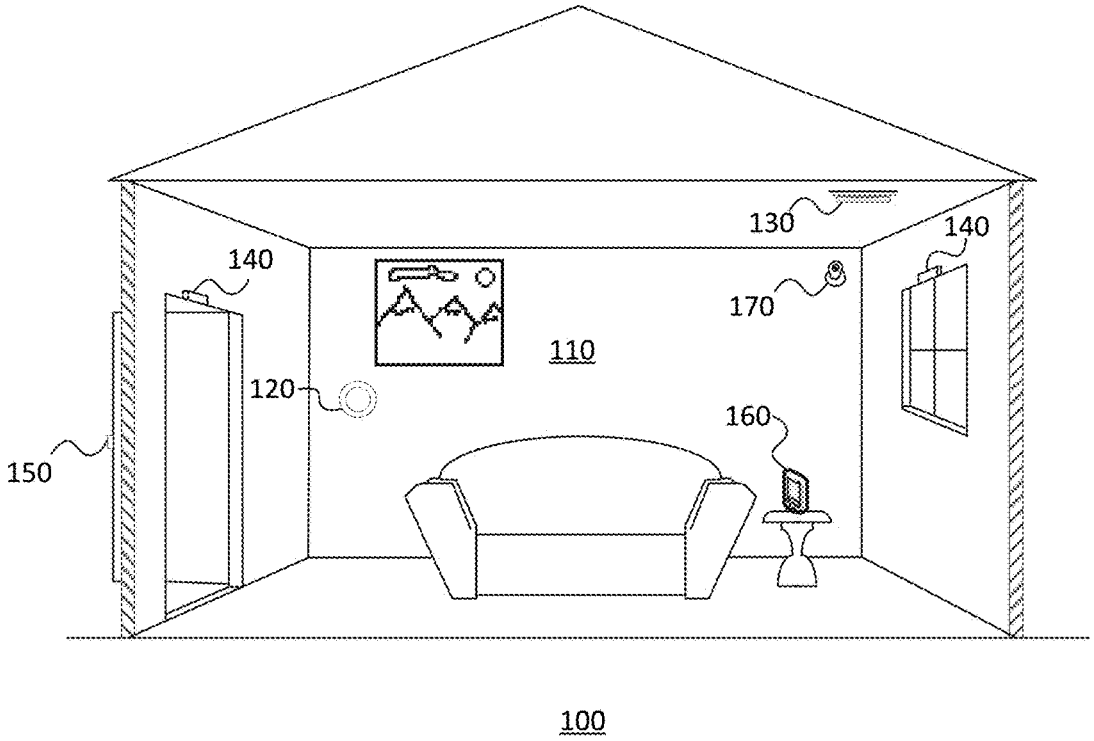
FIG. 1 shows an example premises management system according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosed subject matter may be practiced without these specific details, or with other methods, components, materials, etc. In other instances, well-known structures and devices are shown in block diagram form to facilitate describing the subject disclosure.

The disclosed subject matter relates to a smart security system that may dynamically and automatically address exceptions that occur after the system has been set to a type of alarm mode (e.g., AWAY, STAY) that includes an arming procedure in which sensors are armed according to one or more rules. Herein, "arming" a sensor refers to setting the sensor to a state wherein activities or events detected by the sensor trigger an alarm.

An "exception" refers to an condition in which a component of the security system is not completely secure, not completely functional, or at risk of becoming non-functional, e.g., a window left open, a door left open, a sensor battery low, etc. Exceptions may be classified by the disclosed smart security system as terminal or non-terminal. A "terminal exception" as used herein refers to a condition that causes the system to be unable to function at a predetermined minimum capacity. A "non-terminal exception" as used herein refers to a breach detected by a sensor, an anomalous condition determined based on historical data, or an operational malfunction, potential or manifest, that does not prevent the system as a whole from operating at a predetermined minimum capacity for securing a premises. The "breach" may include, for example, a perimeter opening such as a door or a window that is not completely closed.

The smart security system may notify the user of any existing exceptions when the user sets the system in the alarm mode, but may also proceed to automatically execute the alarm mode's arming procedure if none of the exceptions are terminal exceptions. However, the smart security system will not trigger an alarm if the non-terminal exceptions are corrected. As will be shown below, these features provide added convenience for the user, increase the flexibility of options available when exceptions are detected, and saves time compared to conventional systems.

The disclosed smart security system may detect exceptions based on recent data obtained by sensors, historical data obtained by sensors, other system or device status data, and additional factors as will be described below.

The disclosed smart security system may also share data with and receive data from other systems installed at the premises or accessible through a network, e.g., the Internet or cloud-based services. For example, in some configurations exceptions may be extended to include conditions present in another system in the premises that cause that other system to not perform as expected. For illustrative purposes and to demonstrate example coordination and communications among different types of systems, the disclosed smart security system will be described below as part of a smart home network environment, which will be referred to generically as a "premises management system."

A premises management system as described herein may include a plurality of electrical and/or mechanical components, including intelligent, sensing, network-connected devices that communicate with each other and/or may communicate with a central server or a cloud-computing system to provide any of a variety of security and/or environment management objectives in a home, office, building or the like. Such objectives will collectively be referred to as "premises management," and may include, for example, managing alarms, notifying third parties of alarm situations, managing door locks, monitoring the premises, as well as managing temperature, managing lawn sprinklers, controlling lights, controlling media, etc. A condition that affects any of the premises management tasks could result in an exception.

A premises management system may include multiple systems or subsystems to manage different aspects of premises management. For example, the disclosed smart security system may manage security tasks, while a smart home environment subsystem may handle tasks such as lighting, lawn watering and automated appliances, and an HVAC subsystem may handle temperature adjustments. Each subsystem may include devices, such as sensors, that obtain information about the environment.

The individual hardware components of the premises management system that are used to monitor and affect the premises in order to carry out premises management in general will hereinafter be referred to as "premises management devices." Premises management devices may include multiple physical hardware and firmware configurations, along with circuitry hardware (e.g., processors, memory, etc.), firmware, and software programming that are capable of carrying out the objectives and functions of the premises management system. The premises management devices may be controlled by a "brain" component, as will be described further below, which may be implemented in a controller device or in one or more of the premises management devices.

Turning now to a more detailed discussion in conjunction with the attached figures, FIG. 1 shows an example premises management system 100 that may include the disclosed smart security system. The system 100 may be installed within a premises 110. The system may also include multiple types of premises management devices, such as one or more intelligent, multi-sensing, network-connected thermostats 120, one or more intelligent, multi-sensing, network-connected hazard detection units 130, one or more intelligent, multi-sensing, network-connected entry detection units 140, one or more network-connected door handles (or door locks) 150, one or more intelligent, multi-sensing, network-connected controller devices 160, and one or more intelligent, multi-sensing, network-connected camera devices 170. Data captured by any of these or other devices may be used by the disclosed smart security system, for example, to detect different types of exceptions.

The premises management system 100 may be configured to operate as a learning, evolving ecosystem of interconnected devices. New premises management devices may be added, for example, to introduce new functionality, expand existing functionality, or expand a spatial range of coverage of the system. Furthermore, existing premises management devices may be replaced or removed without causing a failure of the system 100. Such removal may encompass intentional or unintentional removal of components from the system 100 by an authorized user, as well as removal by malfunction (e.g., loss of power, destruction by intruder, etc.). Due to the dynamic nature of the system 100, the overall capability, functionality and objectives of the system 100 may change as the constitution and configuration of the system 100 change. The types of data that may be used by the disclosed smart security system may also correspondingly change. For example, data that indicates environmental sound may be available in one configuration while data that indicates environmental temperature may be available in another configuration.

In order to avoid contention and race conditions among interconnected devices, the disclosed smart security system and the handling of certain system level decisions may be centralized in a "brain" component. The brain component may coordinate decision making across subsystems, the entire system 100, or a designated portion thereof. The brain component is a system element at which, for example, sensor/detector states converge, user interaction is interpreted, sensor data is received, subsystems are coordinated, and decisions are made concerning the state, mode, or actions of the system 100. Hereinafter, the system 100 brain component will be referred to as the "primary system processor." The primary system processor may be implemented, for example, in the controller device 160, via software executed or hard coded in a single device, or in a "virtual" configuration, distributed among one or more external servers or one or more premises management devices within the system. The virtual configuration may use computational load sharing, time division, shared storage, and other techniques to handle the primary system processor functions.

The primary system processor may be configured to implement the disclosed smart security system and to execute software to control and/or interact with the other subsystems and components of the premises management system 100. Furthermore, the primary system processor may be communicatively connected to control, receive data from, and transmit data to premises management devices within the system 100 as well as to receive data from and transmit data to devices/systems external to the system 100, such as third party servers, cloud servers, mobile devices, and the like.

Premises management devices (e.g., 120-150, 170) may include one or more sensors. In general, a "sensor" may refer to any device that can obtain data that provides an indication of a state or condition of its local environment. Such data may be stored or accessed by other devices and/or systems/subsystems. Sensor data and status communications may serve as the basis for information determined about the sensor's environment and as the basis for detecting exceptions.

Any premises management device that can capture data from the environment can be used as a data source for the disclosed smart security system. A brief description of sensors that can function as data sources that may be included in the system 100 follows.

The examples provided below are not intended to be limiting but are merely provided as illustrative subjects to help facilitate describing the subject matter of the present disclosure. It would be impractical and inefficient to list and describe every type of possible data source. It should be understood that deployment of types of sensors that are not specifically described herein will be within the capability of one with ordinary skill in the art.

Sensors may be described by the type of information they collect. In this nomenclature sensor types may include, for example, motion, smoke, carbon monoxide, proximity, temperature, time, physical orientation, position, acceleration, location, entry, presence, pressure, light, sound, and the like. A sensor also may be described in terms of the particular physical device that obtains the environmental data. For example, an accelerometer may obtain acceleration data, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combination thereof.

A sensor further may be described in terms of a function or functions the sensor performs within the system 100. For example, a sensor may be described as a security sensor when it is used to determine security events, such as entry or exit through a door.

A sensor may serve different functions at the same time or at different times. For example, system 100 may use data from a motion sensor to determine the occurrence of an event, e.g., "individual entered room," or to determine how to control lighting in a room when an individual is present, or use the data as a factor to change a mode of a security system on the basis of unexpected movement when no authorized party is detected to be present.

In some cases, a sensor may operate to gather data for multiple types of information sequentially or concurrently. For example, a temperature sensor may be used to detect a change in atmospheric temperature as well as to detect the presence of a person or animal. A sensor also may operate in different modes (e.g., different sensitivity or threshold settings) at the same or different times. For example, a sensor may be configured to operate in one mode during the day and another mode at night.

Multiple sensors may be arranged in a single physical housing, such as where a single device includes movement, temperature, magnetic, and/or other sensors. Such a housing may still be generally referred to as a "sensor" or premises management device.

Figure 2:
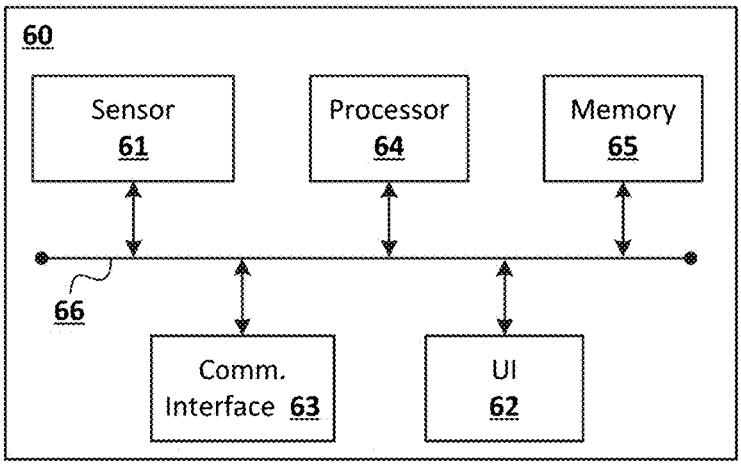
FIG. 2 shows an example premises management device according to an embodiment of the disclosed subject matter.

FIG. 2 shows an example premises management device 60 including a processor 64, a memory 65, a user interface 62, a communications interface 63, an internal bus 66, and a sensor 61. A person of ordinary skill in the art would appreciate that components of the premises management device 60 described herein can include electrical circuit(s) that are not illustrated, including components and circuitry elements of sufficient function in order to implement the device as required by embodiments of the subject disclosure. Furthermore, it can be appreciated that many of the various components listed above can be implemented on one or more integrated circuit (IC) chips. For example, a set of components can be implemented in a single IC chip, or one or more components may be fabricated or implemented on separate IC chips.

The sensor 61 may be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, imager, camera, compass or any other type of sensor that captures data or provides a type of information about the environment in which the premises management device 60 is located.

The processor 64 may be a central processing unit (CPU) or other type of processor chip, or circuit. The processor 64 may be communicably connected to the other components of the premises management device 60, for example, to receive, transmit and analyze data captured by the sensor 61, transmit messages, packets, or instructions that control operation of other components of the premises management device 60 and/or external devices, and process communication transmissions between the premises management device 60 and other devices. The processor 64 may execute instructions and/or computer executable components stored on the memory 65. Such computer executable components may include, for example, a primary function component to control a primary function of the premises management device 60 related to managing a premises, a communication component configured to locate and communicate with other compatible premises management devices, and a computational component configured to process system related tasks.

The memory 65 or another memory device in the premises management device 60 may store computer executable components and also be communicably connected to receive and store environmental data captured by the sensor 61. A communication interface 63 may function to transmit and receive data using a wireless protocol, such as a WiFi, Thread, other wireless interfaces, Ethernet, other local network interfaces, Bluetooth®, other radio interfaces, or the like, and may facilitate transmission and receipt of data by the premises management device 60 to and from other devices.

The user interface (UI) 62 may provide information and/or receive input from a user of system 100. The UI 62 may include, for example, a speaker to output an audible sound when an event is detected by the premises management device 60. Alternatively, or in addition, the UI 62 may include a light to be activated when an event is detected by the premises management device 60. The user interface may be relatively minimal, such as a liquid crystal display (LCD), light-emitting diode (LED) display, an LED or limited-output display, or it may be a full-featured interface such as, for example, a touchscreen, touchpad, keypad, or selection wheel with a click-button mechanism to enter input.

Internal components of the premises management device 60 may communicate via the internal bus 66 or other mechanisms, as will be readily understood by one of skill in the art. One or more components may be implemented in a single physical arrangement, such as where multiple components are implemented on a single integrated circuit. Premises management devices 60 as disclosed herein may include other components, and/or may not include all of the illustrative components shown.

As previously mentioned, sensor 61 captures data about the environment in or around the device 60, and at least some of the data may be translated into information that may be used by the disclosed smart security system to detect exceptions. Through the bus 66 and/or communication interface 63, exceptions, status reports and other functions may be transmitted to or accessible by the smart security system or other components or subsystems of the premises management system 100.

Figure 3:
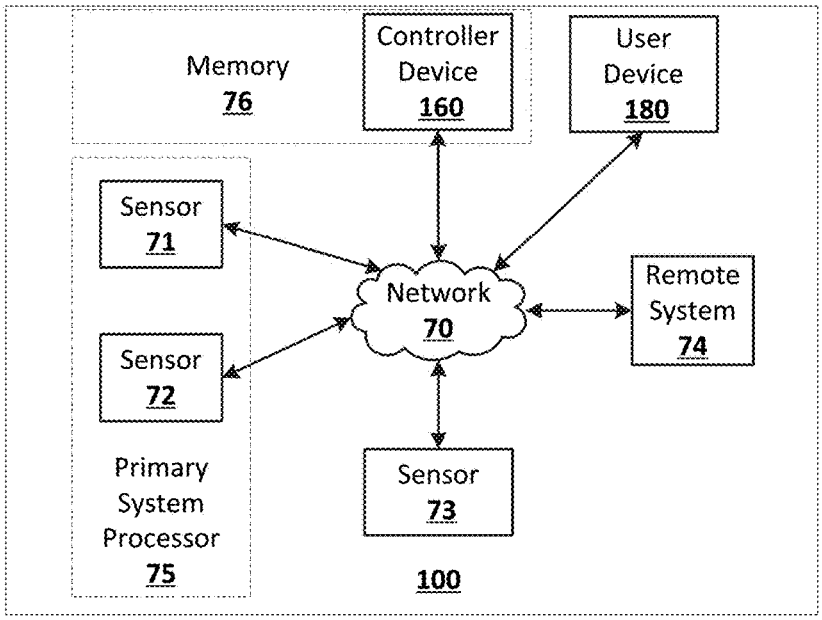
FIG. 3 shows a diagram example of a premises management system which may include an embodiment of the smart security system according to an embodiment of the disclosed subject matter.

FIG. 3 shows a diagram example of a premises management system 100 which may include an embodiment of the smart security system as disclosed herein. System 100 may be implemented over any suitable wired and/or wireless communication networks. One or more premises management devices, i.e., sensors 71, 72, 73, and one or more controller devices 160 (e.g., controller device 160 as shown in FIG. 1) may communicate via a local network 70, such as a WiFi or other suitable network, with each other. The network 70 may include a mesh-type network such as Thread, which provides network architecture and/or protocols for devices to communicate with one another. A user may interact with the premises management system 100, for example, using a user device 180, such as a computer, laptop, tablet, mobile phone, watch, wearable technology, mobile computing device, or using the controller device 160.

In the diagram of FIG. 3 a primary system processor 75 is shown implemented in a distributed configuration over sensors 71 and 72, and a memory 76 is shown implemented in controller device 160. However, the controller device 160 and/or any one or more of the sensors 71, 72, 73, may be configured to implement the primary system processor 75 and memory 76 or any other storage component required to store data and/or applications accessible by the primary system processor 75. The primary system processor 75 may implement the disclosed smart security system and may receive, aggregate, analyze, and/or share information received from the sensors 71, 72, 73, and the controller device 160. Furthermore, a portion or percentage of the primary system processor 75 and/or memory 76 may be implemented in a remote system 74, such as a cloud-based reporting and/or analysis system.

The premises management system 100 shown in FIG. 3 may be a part of a smart-home environment which may include a structure, such as a house, apartment, office building, garage, factory, mobile home, or the like. The system 100 can control and/or be coupled to devices and systems inside or outside of the structure. One or more of the sensors 71, 72 may be located inside the structure or outside the structure at one or more distances from the structure (e.g., sensors 71, 72 may be disposed at points along a land perimeter on which the structure is located, such as a fence or the like).

Sensors 71, 72, 73 may communicate with each other, the controller device 160 and the primary system processor 75 within a private, secure, local communication network that may be implemented wired or wirelessly, and/or a sensor-specific network through which sensors 71, 72, 73 may communicate with one another and/or with dedicated other devices. Alternatively, as shown in FIG. 3, one or more sensors 71, 72, 73 may communicate via a common local network 70, such as a Wi-Fi, Thread or other suitable network, with each other and/or with a controller 160 and primary system processor 75. Sensors 71, 72, 73 may also be configured to communicate directly with the remote system 74.

Sensors 71, 72, 73 may be implemented in a plurality of premises management devices, such as intelligent, multi-sensing, network-connected devices, that can integrate seamlessly with each other and/or with a central processing system or a cloud-computing system (e.g., primary system processor 75 and/or remote system 74). Such devices may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entry-way interface devices (e.g., "smart doorbells"). The smart hazard detectors, smart thermostats, and smart doorbells may be the sensors 71, 72, 73 shown in FIG. 3. These premises management devices may be used by the disclosed smart security system to detect exceptions and report statuses, but may also execute a separate, primary function.

For example, a smart thermostat may detect ambient climate characteristics (e.g., temperature and/or humidity) and may be used to control an HVAC system. In other words, ambient client characteristics may be detected by sensors 71, 72, 73 shown in FIG. 3, and the controller 160 may control the HVAC system (not shown) of the structure. However, the sensors may also transmit data that serves as status report, such as data indicating a battery level or transmit a "heart-beat" signal that indicates that the sensors are functioning properly, or otherwise provide information that the smart security system can use to detect an exception.

As another example, a smart hazard detector may detect light and the presence of a hazardous substance or a substance indicative of a hazardous substance (e.g., smoke, fire, or carbon monoxide). Light, smoke, fire, carbon monoxide, and/or other gasses may be detected by sensors 71, 72, 73 shown in FIG. 3, and the controller 160 may control an alarm system to provide a visual and/or audible alarm to the user of the smart-home environment based on data from sensor 71. However, the detector may also transmit data indicating light is detected in a room that is normally dark, transmit status information, and other types of data that can be used to detect exceptions. Furthermore, the speaker of the hazard detector can also be used to by the disclosed smart security system to announce notifications of exceptions.

As another example, one or more intelligent, multi-sensing, network-connected entry detectors (e.g., "smart entry detectors") may be specifically designed to function as part of the smart security system. Such detectors may be or include one or more of the sensors 71, 72, 73 shown in FIG. 3. The smart entry detectors may be disposed at one or more windows, doors, and other entry points of the smart-home environment for detecting when a window, door, or other entry point is opened, broken, breached, and/or compromised. The smart entry detectors may generate a corresponding detection signal to be transmitted to the controller 160, primary system processor 75, and/or the remote system 74 when a window or door is opened, closed, breached, and/or compromised. The detection signal may provide data to the disclosed smart security system in order to serve as the basis for detecting exceptions.

Smart thermostats, smart hazard detectors, smart doorbells, smart entry detectors, and other premise management devices of the system 100 (e.g., as illustrated as sensors 71, 72, 73 of FIG. 3) can be communicatively connected to each other via the network 70, and to the controller 160, primary system processor 75, and/or remote system 74.

The disclosed smart security system may also include user specific features. Generally, users of the premises management system 100 may interact with the system 100 at varying permission and authorization levels. For example, users may have accounts of varying class with the system 100, each class having access to different features such as the ability to alter exception classifications or define special exceptions based on the configuration of the premises management system.

Users may be identified as account holders and/or verified for communication of control commands. For example, some or all of the users (e.g., individuals who live in a home) can register an electronic device, token, and/or key fob with the premises management system 100 to enable to system 100 to identify the users and provide customized services. Such registration can be entered, for example, at a website, a system 100 interface (e.g., controller device 160), or a central server (e.g., the remote system 74) to bind the user and/or the electronic device to an account recognized by the system 100.

Alternatively, or in addition to registering electronic devices, the premises management system 100 may make inferences about which individuals reside or work in the premises and are therefore users and which electronic devices are associated with those individuals. As such, the system 100 may "learn" who is a user (e.g., an inferred authorized user) and may respond to communications from the electronic devices associated with those individuals, e.g., executing applications to control the network-connected smart devices of the system 100 or to confirm or customize features of the smart security system.

Once users (and their respective devices) have been registered or verified, the smart security system may send notifications of exceptions and status reports to the users via electronic messages, for example, sent via email, short message service (SMS), multimedia messaging service (MMS), unstructured supplementary service data (USSD), as well as any other type of digital messaging services and/or communication protocols.

Referring to FIG. 3, the controller device 160 may be implemented using a general- or special-purpose computing device. A general-purpose computing device running one or more applications, for example, may collect and analyze data from one or more sensors 71, 72, 73 installed in the premises and thereby function as controller device 160. In this case, the controller device 160 may be implemented using a computer, mobile computing device, mobile phone, tablet computer, laptop computer, personal data assistant, wearable technology, or the like. In another example, a special-purpose computing device may be configured with a dedicated set of functions and a housing with a dedicated interface for such functions. This type of controller device 160 may be optimized for certain functions and presentations, for example, including an interface specially designed to review exceptions and create customized exception definitions, as will be described further below.

The controller device 160 may function locally with respect to the sensors 71, 72, 73 with which it communicates and from which it obtains sensor data, such as in the case where it is positioned within a home that has a premises management system 100 installed therein. Alternatively or in addition, controller device 160 may be remote from the sensors 71, 72, 73, such as where the controller device 160 is implemented as a cloud-based system that communicates with multiple sensors 71, 72, 73, which may be located at multiple locations and may be local or remote with respect to one another.

Figure 4:
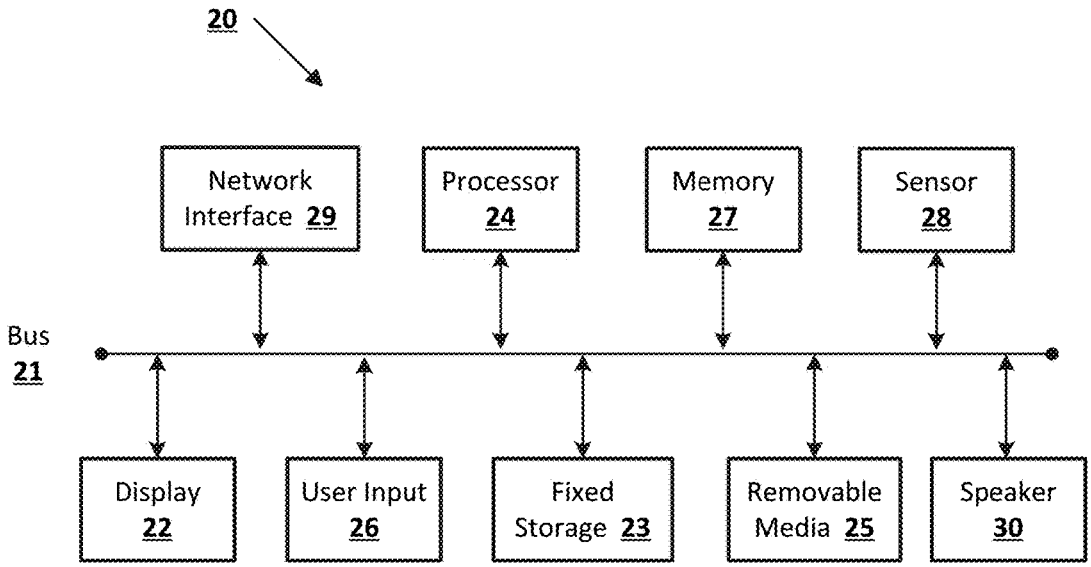
FIG. 4 shows an example computing device suitable for implementing a controller device according to an embodiment of the disclosed subject matter.

FIG. 4 shows an example computing device 20 suitable for implementing the controller device 160. The computing device 20 may include a bus 21 that interconnects major components of the computing device 20. Such components may include a central processor 24; a memory 27, such as Random Access Memory (RAM), Read Only Memory (ROM), flash RAM, or the like; a sensor 28, which may include one or more sensors as previously discussed herein; a user display 22, such as a display screen; a user input interface 26, which may include one or more user input devices such as a keyboard, mouse, keypad, touch pad, turn-wheel, and the like; a fixed storage 23 such as a hard drive, flash storage, and the like; a removable media component 25 operable to control and receive a solid-state memory device, an optical disk, a flash drive, and the like; a network interface 29 operable to communicate with one or more remote devices via a suitable network connection; and a speaker 30 to output an audible communication to the user. In some embodiments the user input interface 26 and the user display 22 may be combined, such as in the form of a touch screen.

The bus 21 allows data communication between the central processor 24 and one or more memory components 25, 27, which may include RAM, ROM, and other memory, as previously noted. Applications resident with the computing device 20 are generally stored on and accessed via a computer readable storage medium.

The fixed storage 23 may be integral with the computing device 20 or may be separate and accessed through other interfaces. The network interface 29 may provide a direct connection to the premises management system and/or a remote server via a wired or wireless connection. The network interface 29 may provide such connection using any suitable technique and protocol, as will be readily understood by one of skill in the art, including digital cellular telephone, WiFi, Thread, Bluetooth®, near-field, and the like. For example, the network interface 29 may allow the computing device 20 to communicate with other components of the premises management system, other computers via one or more local, wide-area, or other communication networks, as described in further detail herein.

Figure 5A:
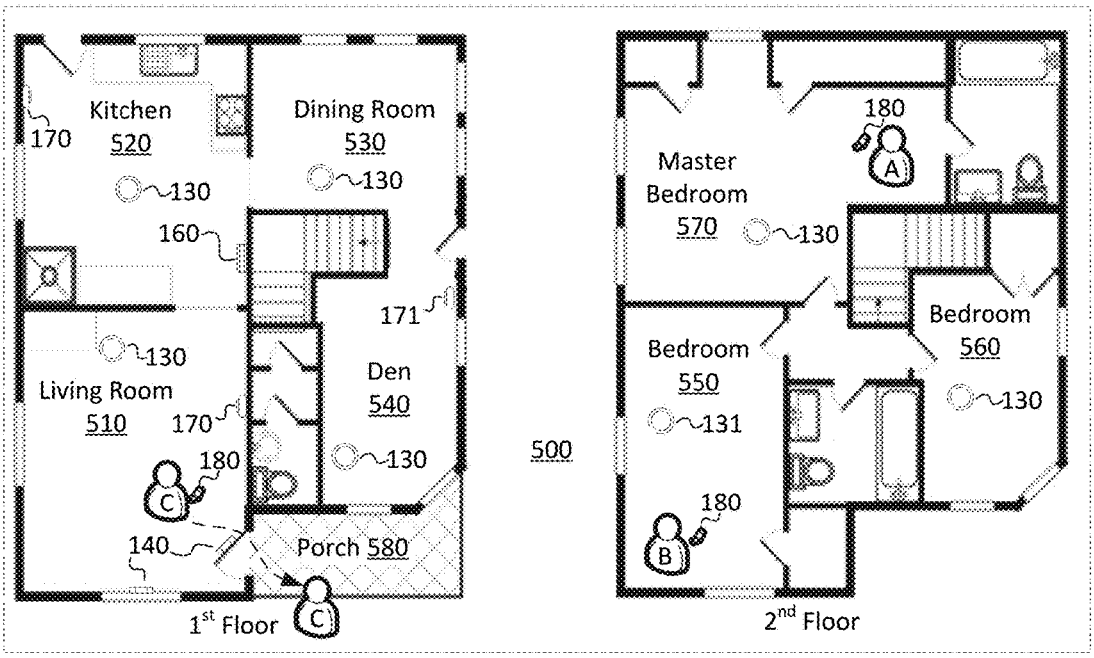
FIG. 5A shows a layout of a two-floor house 500 including a premises management system installed therein according to an embodiment of the disclosed subject matter.

FIG. 5A shows a layout of a two-floor house 500 including an example premises management system as described above installed therein. The house 500 includes a living room 510, kitchen 520, dining room 530, den 540, bedroom 550, bedroom 560, master bedroom 570, and porch 580. Authorized individual A, B, and C are present within the house 500, each carrying a mobile phone 180.

A premises management system 100 installed in the house 500 includes an embodiment of the disclosed smart security system. Referring to FIGS. 1 and 5, the system 100 may include network-connected hazard detection units 130 installed throughout the house 500, network-connected entry detection units 140 installed at windows and doors throughout the house, a network-connected controller device 160, and network connected cameras 170. For simplicity and to avoid unnecessary clutter in the figure, only one window entry detection unit 140, one door entry detection unit 140, and two cameras 170 are illustrated, but it should be understood that entry detection units 140 may be installed at multiple windows and/or doors throughout the house 500, cameras 170 may be installed in other rooms and outside of the house 500, and that other premise management devices (e.g., smart thermostats, smart doorbells, motion detectors, light detectors etc.) as described above may be installed as part of the system 100.

As previously discussed, an exception is any condition that prevents a system within the premises management system from performing as expected. The disclosed smart security system may function as a gateway that reports exceptions to a user, since in many cases the security system will be the last system that a user interacts with before physically leaving the premises.

The disclosed smart security system may categorize exceptions as security and non-security exceptions. Security exceptions are related to some aspect of the security of the premises, such as windows, doors, motion sensor status, etc. Non-security exceptions are related to any other aspect of the premises, such as lighting, sprinkling, media, etc.

Furthermore, security exceptions may be categorized as terminal and non-terminal exceptions. Terminal exceptions are exceptions that cause the smart security system to be unable to function at a predetermined minimum capacity. Example terminal exceptions may include loss of power to critical components, loss of communication with a majority of sensors, or the like. Non-terminal exceptions do no inhibit the functioning of the smart security system such that it cannot function at the predetermined minimum capacity. Non-terminal exceptions may include a window not fully closed, a light left on in a room that is normally dark, or the like.

Figure 5B:
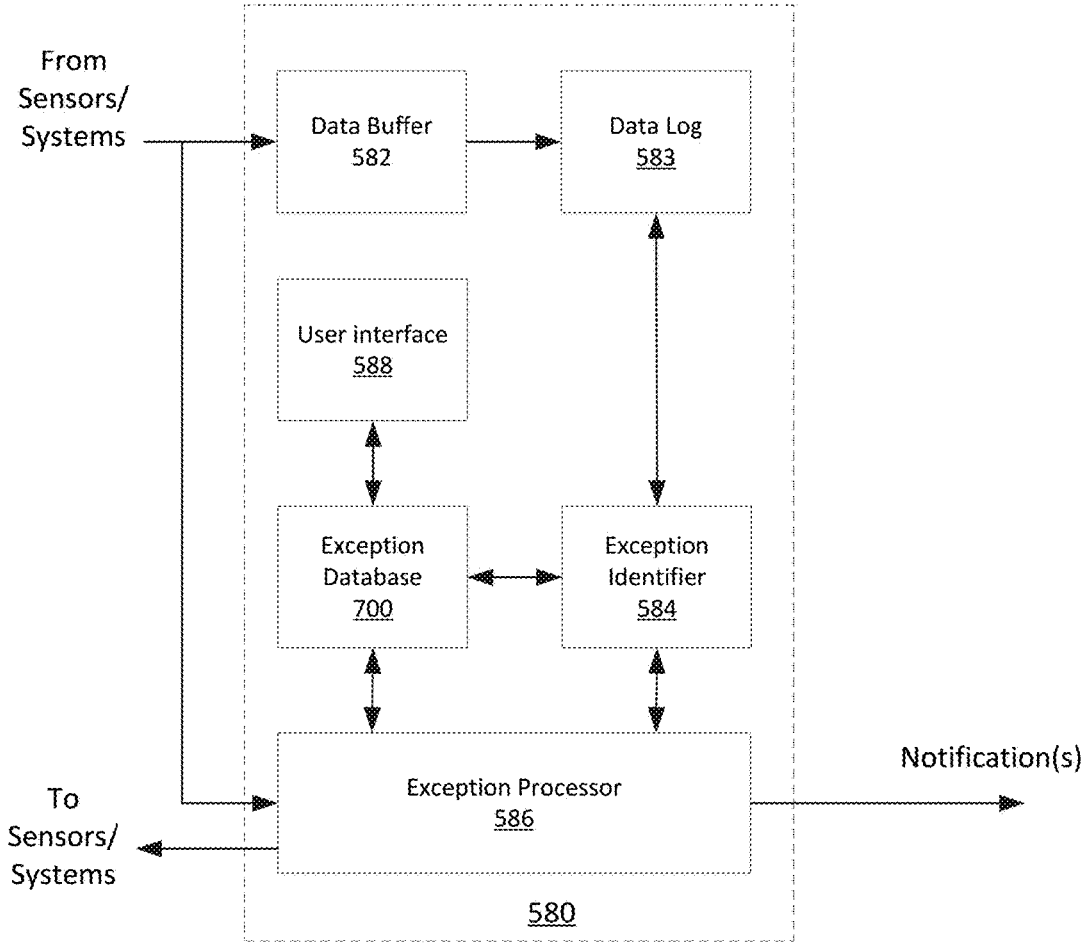
FIG. 5B shows a smart security system according to an embodiment of the disclosed subject matter.

FIG. 5B shows an embodiment of a smart security system 580 that may be implemented within the premises management system 100 in the premises 500. The smart security system 580 may include, among other components, a data buffer 582, a data log 583, an exception identifier 584, a user interface 588, an exception database 700 and an exception processor 586.

Generally, the smart security system 580 may be configured to send out requests for information and to store and analyze captured data and status report data received from other systems in the premises management system or sensors, e.g., premises management devices 130, 140, 160, 170 (FIG. 5A), in order to determine whether an exception condition exists at a time when a user activates an alarm mode of the security system. When one or more exceptions are determined to exist, the system 580 may be configured to transmit a notification to the user. Depending on the nature of the exception and the response of the user, the system 580 may either proceed to execute the arming procedure of the alarm mode or abort the arming process.

Exceptions may be determined based on user input and/or the data received from sensors and from other systems. The data buffer 582 may receive and temporarily store data from other systems and from sensors on an on-going basis. The data may include conditions detected in the premises, device status reports, heartbeat signals, etc. The example conditions may include open doors or windows, lights left on, music left playing, a sprinkler left on, etc.

The data log 583 may selectively store data from the data buffer 582. For example, the data log 583 may store data according to a rule or algorithm that is applied based on an amount of storage space available in the system. Example rules may include: store data in a time range (e.g., the last ten minutes) based on a trigger event, store data samples on a periodic basis, store new data when there is a change in the data above a threshold amount, store data only from select devices, or other rules that may reduce or classify the amount and/or type of data that is stored long term in the data log 583. Furthermore, the data log 583 may be configured to store data for a set period of time, e.g., one week, the last 30 days, the last 90 days, or the like.

The data storage rule and data storage period applied by the data log 583 may change, for example, based on a command or setting, based on available storage capacity, or based on a given mode of the smart security system 580. For example, if the smart security system 580 is configured to be implemented by premises management devices in a dynamic premises management system 100, then the data storage capacity may change when new devices are added or removed from the system, and the data storage rule may be automatically adjusted accordingly.

The exception identifier 584 may determine whether an exception exists based on the data log 583 and the exception database 700. In one embodiment, the exception identifier 584 may also identify "new" exceptions based on the data log 583. In this case, an exception may be identified as a condition that is out of the ordinary beyond a threshold amount. The exception identifier 584 may be configured to periodically identify data trends that can serve as the basis for exception definitions. When data from a given sensor consistently indicates, over a period of time, that a certain condition exists under a particular circumstance, an exception definition can be created. The given sensor may be a security sensor or a sensor associated with a different system in the premises management system, such as a lighting system, HVAC system, sprinkler system, multimedia system, etc. The exception identifier 584 may store the exception definition in the exception database 700.

FIG. 7 shows an example exception database 700. Referring to FIGS. 5A, 5B, and 7, in one example the data log 583 may indicate that over the past thirty days, whenever the user has activated the AWAY mode at controller 160 and exited the premises after 7:00 PM, data from the light sensor on thermostat 130 in the den 540 has indicated that the lights in the den are off. Based on this, the exception identifier may store a new normal condition exception entry 710 in the database 700, e.g., (device identifier)=(min value, max value): DEN_TS_LIGHT=(1,15). Accordingly, when the user activates AWAY mode at 8:15 PM and the thermostat 130 outputs a value of 55 that indicates lights are on in the den 540, an exception may be determined to exist.

In addition to new, customized exception definitions, the exception database 700 may include one or more exception definitions defined by a user via user interface 588. For example, a user may desire to have a reminder for a given condition immediately. In one scenario, a recent house guest B constantly leaves music playing in the bedroom 550 when leaving the house 500. As a reminder to turn it off, the user may set a custom exception definition 720 of low sound in the bedroom: BDR_TS_SOUND=(1,10). When guest B leaves the house and activates the AWAY mode and the thermostat 131 outputs a value 89 that indicates loud sound is present in the bedroom 550, an exception may be determined to exist.

Furthermore, the exception database 700 may include at least one or more default security exception rules 730. These rules include the basic definitions of security exceptions, terminal and non-terminal, and may depend upon the configuration of the security system. Example rules may include (in layman's terms): 1) entry detector sensors must indicate that their corresponding entries are completely closed, 2) battery-operated sensors must indicate a threshold amount of power, 3) sensors must provide an indication that data communication from the sensor is operational. That is, based on rule 1, a window or door that is not detected to be completely closed will generate an exception, based on rule 2 a thermostat with low battery power remaining beneath the threshold will generate an exception, etc.

The exception database may also include a setting of whether the exception may be automatically overridden or the exception requires a manual override. Herein, an "override" refers to whether the system may proceed to complete the arming procedure of the alarm mode despite the existence of the exception (automatic) or whether the system requires user approval before proceeding (manual), or the system will not override (terminal). However, the override setting of an exception may be changed by an authorized user.

If a particular non-terminal exception is automatically overridden more than a threshold number of times over a predetermined time period, the system may be configured to suggest to the user the option to remove the exception rule from the exception database or to permanently disable the particular sensor that is generating the exception. This feature would help reduce the amount of messages that are sent to the user on each arming session, while allowing the system to highlight the important/critical conditions. For example, a threshold number of overrides could be five, and a predetermined time period could be one week. In one scenario, a window in a second floor bedroom is always open for ventilation and gets automatically overridden on five consecutive arm session over two days. In this case, the smart security may present the user with an option to disable the sensor installed at the window as an input to the security system for a set amount of time (e.g., 30 days) or permanently.

As previously discussed, the disclosed smart security system determines whether exceptions exist at a time $T_0$ when a user activates an alarm mode of the system, e.g., when the user sets the system to AWAY mode or STAY mode. To determine whether an exception exists at $T_0$, the exception processor 586 analyzes a current sampling of data. This sampling may be received in any of various ways. For example, the exception processor 586 may transmit a request for information to sensors and systems in the premises management system. The sensors and systems may respond by transmitting a current data detection reading and a current status. In one embodiment, the data may be received and analyzed directly by the exception processor 586. The exception processor 586 may compare data against the exception database 700 to determine whether any exception exists.

In one embodiment the data may be received by the data buffer 582. Some or all of the data may be transferred to the data log 583 and the exception processor 586 may transmit a command to the exception identifier 584 to determine whether any exceptions exist.

When exceptions are determined to exist, the exception processor 586 transmits one or more notifications to the user to inform the user of the exceptions. The notifications may be transmitted audibly via a speaker of the smart security system or electronically, for example, via a user interface display of the smart security system, a text message or email to a registered communication device of the user, or any combination thereof. For terminal exceptions, the notification may indicate the exception and notify the user that the arming procedure will be terminated upon expiration of the exit allowance time (that is, the completion of the arming phase) if the exception is not corrected. For automatic non-terminal exceptions the notification may indicate that the arming procedure will proceed automatically even if the exception is not corrected. For manual non-terminal exceptions the notification may indicate that the arming procedure will be terminated upon expiration of the exit allowance time unless the user consents to arming despite the exception.

As shown in FIG. 7, exceptions may be assigned a "priority" value in the exception database 700 so that the notifications may be presented to the user in a manner based on the level of importance. For example, terminal exceptions or exceptions of relatively high importance may be presented audibly, highlighted in a color on a display, presented first, or otherwise emphasized over exceptions of relatively low importance.

The exception database 700 may contain additional metadata not shown in FIG. 7. The metadata may describe sensors, exceptions or conditions to allow sorting, classifying or presenting data to the user in various customizable ways. Examples of metadata may include a type, age, manufacturer, installation/creation date, etc., of a sensor or, where applicable, an exception. For example, in a configuration that results in multiple exceptions, the smart security system may be configured to consolidate notifications by class and present a summary to the user with the option to review any particular exception in greater detail. In this example, rather than listing each exception the smart security system may report, "Two windows are open, three devices have low battery. Press info to hear each condition."

The disclosed smart security system may handle non-terminal security exceptions that involve perimeter breaches in a special manner. Specifically, for any perimeter breach that remains uncorrected by the time the arming phase is completed, the system may arm the sensor but allow the exception to be corrected without triggering an alarm. An illustrative example will now be provided.

Referring to FIGS. 5A and 5B, user C hypothetically sets the system to STAY mode. In this mode, all perimeter sensors are armed. The exception processor 586 sends out a request for data from the sensors. The exception processor 586 compares the data received in response to the request against the exception rules stored in the exception database 700 and determines that an exception exists: the data from an entry detector sensor a window in the kitchen 520 indicates that the window is not completely closed. The exception processor 586 transmits a notification in the form of an audible message via a speaker on controller 160: "Kitchen window is open."

User C recalls that the window was left slightly open to air out the kitchen and decides not to do anything about it at the moment. The smart security system automatically proceeds to arm the perimeter sensors and switches the system setting to STAY mode. All perimeter sensors, including the entry detector monitoring the kitchen window, are armed. Sometime later user C feels that the kitchen is chilly and decides to close the kitchen window. Not thinking about the alarm setting, user C completely closes the kitchen window. In this case, the smart security system is configured not to trigger an alarm. By default, the rule is as follows: in an alarm mode in which perimeter sensors are armed by overriding an exception based on a detected perimeter breach, a complete correction of the exception condition (e.g., the breach) will not trigger an alarm. In other words, completely closing an open door or window will not trigger an alarm.

On the other hand, a mere adjustment of the exception condition will trigger an alarm. In other words, if the a partially opened window is opened further, this action will trigger an alarm.

Figure 6:
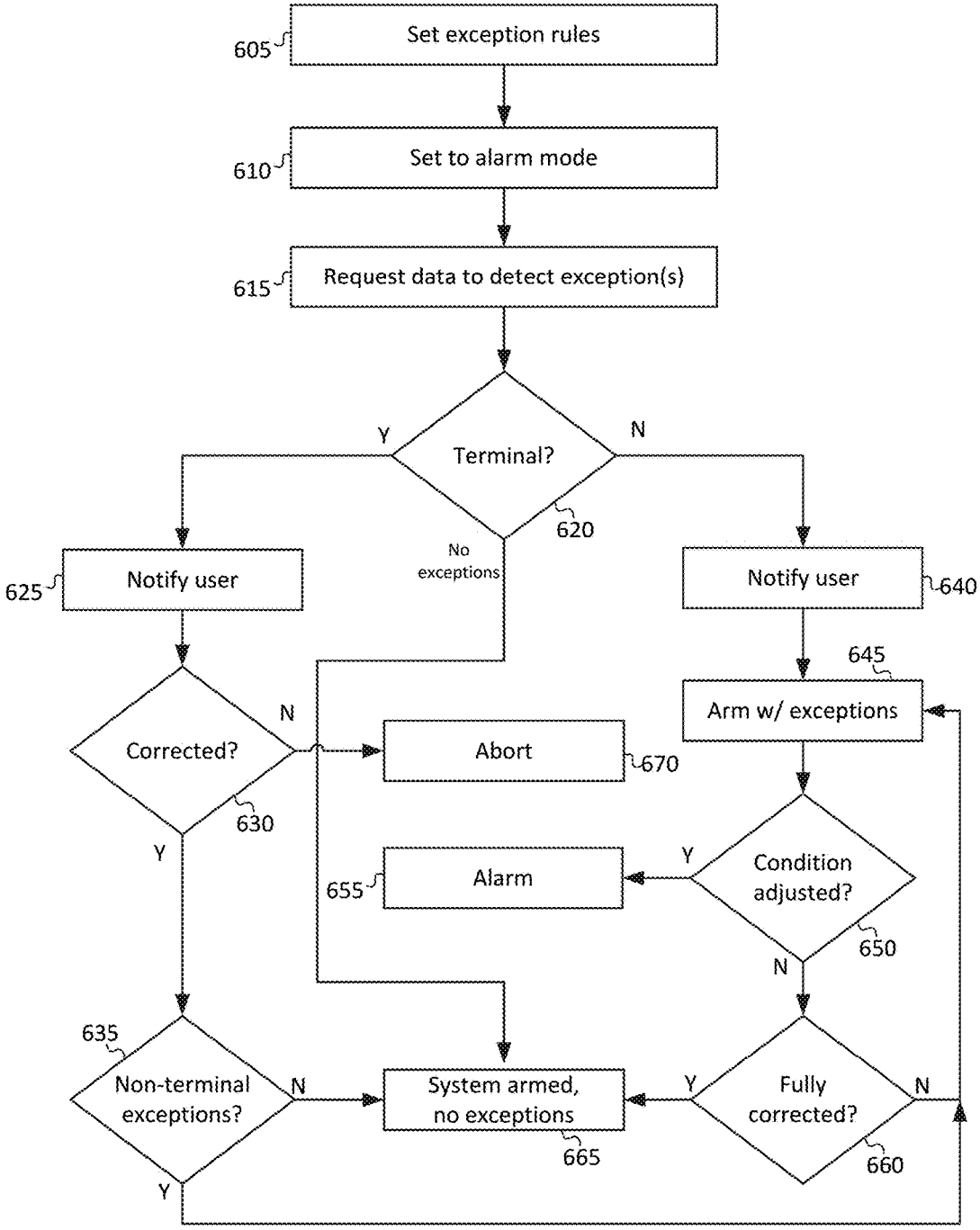
FIG. 6 shows a flowchart of operations according to an embodiment of the disclosed subject matter.

FIG. 6 shows a flowchart 600 of operations of the disclosed smart security system. At operation 605 the exception rules are set. This may be done, for example, by a default set of rules included in the system by the manufacturer, by a custom rule implemented by user input, and/or by rules learned by the system over time based on a history of captured data, or any combination thereof.

At operation 610 the user sets the system to an alarm mode. The alarm mode is any mode the requires arming security sensors, such as, for example, an AWAY mode in which all security sensors interior and perimeter are armed or a STAY mode in which only perimeter security sensors are armed.

At operation 615 the exception processor transmits a request to sensors and systems of the premises management system for a status and conditions check. In response, the sensors and systems transmit data to the smart security system. The data may include data that indicates the current conditions detected by sensors and data that indicates a device or system status, such as a heartbeat signal, a battery power level, or a system setting. Based on the received data and the exception rules stored in the exception database 700, the exception processor determines whether any exceptions currently exist.

At operation 620 the exception processor determines whether any terminal exceptions exist. If no exceptions have been detected at all, then the system completes the arming procedure and proceeds to operation 665 at which the system is fully armed according to the alarm mode with no exceptions.

If a terminal exception is detected, then at operation 625 the smart security system transmits a notification to the user. The notification may be transmitted electronically, for example, via a text message or email to a registered device, via a display panel on a user interface in a controller of the smart security system, or audibly through a speaker of the controller or other premises management device. The notification may inform the user of all exceptions that exist, indicate that at least one is a terminal exception, identify the terminal exception, and inform the user that the smart security system will be unable to complete the arming procedure of the alarm mode due to the terminal exception. The notification may include options that allow the user to request additional time to correct the exception.

At operation 630 the system determines whether the terminal exception has been corrected. If the exception has not been corrected, the system aborts the arming procedure at operation 670. If the exception has been corrected, at operation 635 the smart security system checks whether any non-terminal exceptions remain. If no exceptions remain, then the system completes the arming procedure and the system is fully armed at operation 665. If non-terminal exceptions exist that have not been corrected, then the system proceeds to operation 645 and automatically overrides the remaining non-terminal exceptions.

At operation 620, if only non-terminal exceptions were detected then the system notifies the user at operation 640 and proceeds to automatically override the exceptions and complete the arming procedure at 645. In some cases, depending on the configuration of the sensors in the smart security system, in order to override the exception one or more sensors may be disabled.

The procedure to disable one or more sensors is dependent upon the configuration of sensors at a given premises and may be designated to reduce false alarms. For example, a window may have two or more sensors monitoring activity of the window. A first sensor may detect a breaking of the window, a second sensor may detect an opening/closing of the window and a third sensor may detect motion in the space around the window inside the premises. In this case, the exception may be triggered by data from the second sensor indicating that the window is open. To override this exception, the system may disable the third sensor (motion detector) while leaving the other sensors armed, since, in this configuration, an open window may allow a breeze blow a curtain inside the premises.

At operation 645 the system is therefore armed with exceptions existing. If any of the existing exceptions are security exceptions (for example, an open window) then at operation 650, if any of the security exceptions are adjusted without resulting in a complete correction of the exception, then the alarm is triggered at operation 655. For example, if an open window was detected as an exception and overridden, if that window is opened wider the smart security system will trigger an alarm.

At operation 660 if the existing security exception is completely corrected, for example, the window is completely closed, then the system may fully arm any sensor associated with the exception condition. For example, if a motion sensor associated with a window had been disabled as part of the override procedure, the sensor can now be armed. The system may transmit a notification to the user indicating that the exception has been corrected. If no exceptions remain then the system is fully armed without exception at 665.

Accordingly, the disclosed smart security system provides many features that enhance the convenience of using a security system, save time, and reduces false alarms. The system can also save money for the user and aid the user in managing the premise by learning new exceptions that can serve as the basis for alerting the user of conditions that are out of the ordinary before the user physically leaves.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Some portions of the detailed description have been presented in terms of algorithms and symbolic representations of operations on data bits within a computer memory. These algorithmic descriptions and representations are commonly used by those skilled in the data processing arts to most effectively convey the substance of their work to others skilled in the art. An algorithm is here and generally, conceived to be a self-consistent sequence of steps leading to a result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "receiving," "determining," "analyzing," "calculating," "identifying," "storing," "capturing," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Some portions of the disclosed smart security system have been described with respect to interaction between several components/blocks. A person of ordinary skill in the art would appreciate that such systems/circuits and components/blocks can include those components or specified sub-components, some of the specified components or sub-components, and/or additional components, according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of ordinary skill in the art.

Furthermore, while for purposes of simplicity of explanation some of the disclosed methodologies have been shown and described as a series of operations within the context of various block diagrams and flowcharts, it is to be understood and appreciated that embodiments of the disclosure are not limited by the order of operations, as some operations may occur in different orders and/or concurrently with other operations from that shown and described herein. For example, those skilled in the art will understand and appreciate that a methodology can alternatively be represented as a series of interrelated states or events, such as in a state diagram. Moreover, not all illustrated operations may be required to implement a methodology in accordance with the disclosed subject matter. Additionally, it is to be further appreciated that the methodologies disclosed hereinafter and throughout this disclosure are capable of being stored on an article of manufacture to facilitate transporting and transferring such methodologies to computers. The term article of manufacture, as used herein, is intended to encompass a computer program accessible from any computer-readable device or non-transitory storage media.

More generally, various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A method of controlling a security system of a premises, comprising:

storing data captured from one or more sensors during a first period of time;

storing data captured from the one or more sensors during a second period of time that does not coincide with the first period of time;

determining a first exception rule based on a same condition existing under a same circumstance during the first period of time and during the second period of time;

storing the first exception rule in a database;

detecting an exception based on the first exception rule stored in the database when the security system is set to an alarm mode;

transmitting, to a user, a notification identifying the exception; and automatically executing an arming procedure according to the alarm mode.

2. The method of claim 1, wherein the first exception rule is determined based on data obtained from one or more sensors that are not a part of the security system.

3. The method of claim 2, wherein the one or more sensors are part of a second system selected from the group consisting of: an HVAC system, a lighting system, a sprinkler system, and a multimedia system.

4. The method of claim 3, wherein the alarm mode is AWAY, the same condition is a data from a light sensor indicating that a light is off, and the first exception is determining that the light is on.

5. The method of claim 1, wherein the first exception rule is based on a condition present in another system in the premises that causes the other system to not perform as expected.

6. The method of claim 1, wherein the notification is transmitted to the user via a text message to a communications device registered with the security system.

7. The method of claim 1, further comprising:

receiving a user input of a second exception rule;

storing the second exception rule in the database;

detecting a second exception based on the second exception rule when the security system is set to the alarm mode;

transmitting, to a user, a notification identifying the second exception; and automatically executing an arming procedure according to the alarm mode.

8. A security system installed in a premises, comprising:

a plurality of sensors;

a data log that stores data received from the plurality of sensors during a first period of time and during a second period of that does not coincide with the first period of time;

an exception identifier that determines one or more exception rules based on a same condition existing under a same circumstance during the first period of time and during the second period of time;

an exception database that stores one or more exception rules identified by the exception identifier; and a processor that:

detects an exception based on an exception rule stored in the database when the security system is set to an alarm mode, transmits, to a user, a notification identifying the exception, and automatically executes an alarm arming procedure according to the alarm mode.

9. The security system of claim 8, wherein the exception identifier identifies one or more trends in the stored date and determines the one or more exception rules based on the identified trends.

10. The security system of claim 8, wherein the exception identifier identifies the one or more trends when data from a given sensor consistently indicates, over a period of time, that a certain condition exists under a particular circumstance, and wherein the exception identifier determines the exception rule based on the certain condition and the particular circumstance.

11. The security system of claim 8, wherein the one or more exception rules are determined based on data obtained from one or more sensors that are not a part of the security system.

12. The security system of claim 11, wherein the one or more sensors are part of a second system selected from the group consisting of: an HVAC system, a lighting system, a sprinkler system, and a multimedia system.

13. The security system of claim 8, wherein the processor transmits the notification to the user via a text message to a communications device registered with the security system.

* * * * *